US008933772B2

(12) United States Patent
Suzuki et al.

(10) Patent No.: US 8,933,772 B2
(45) Date of Patent: Jan. 13, 2015

(54) COIL COMPONENT

(75) Inventors: Mitsuaki Suzuki, Nagano (JP); Masahiro Tanaka, Nagano (JP)

(73) Assignee: Minebea Co., Ltd., Nagano (JP)

( * ) Notice: Subject to any disclaimer, the term of this patent is extended or adjusted under 35 U.S.C. 154(b) by 45 days.

(21) Appl. No.: 13/495,150

(22) Filed: Jun. 13, 2012

(65) Prior Publication Data

US 2012/0326831 A1 Dec. 27, 2012

(30) Foreign Application Priority Data

Jun. 21, 2011 (JP) ..... 2011-136922

(51) Int. Cl.

| | |
|---|---|
| ***H01F 27/30*** | (2006.01) |
| ***H01F 27/24*** | (2006.01) |
| ***H01F 17/06*** | (2006.01) |
| ***H01F 27/26*** | (2006.01) |
| *H01F 3/14* | (2006.01) |

(52) U.S. Cl.

CPC ..... *H01F 27/263* (2013.01); *H01F 3/14* (2013.01)

USPC ..... 336/198; 336/199; 336/185; 336/207; 336/212; 336/178

(58) Field of Classification Search

USPC ..... 336/198, 199, 205, 207, 209, 212, 213

See application file for complete search history.

(56) References Cited

U.S. PATENT DOCUMENTS

| | | | | |
|---|---|---|---|---|
| 3,750,073 | A * | 7/1973 | Okano | 336/198 |
| 4,234,865 | A * | 11/1980 | Shigehara | 336/92 |
| 6,600,402 | B1 * | 7/2003 | LaFleur et al. | 336/61 |
| 6,771,157 | B2 * | 8/2004 | Nishikawa et al. | 336/178 |
| 7,199,694 | B2 * | 4/2007 | Hao | 336/208 |
| 2003/0080844 | A1 * | 5/2003 | Nishikawa et al. | 336/178 |
| 2010/0176907 | A1 * | 7/2010 | Hayasaki et al. | 336/220 |

FOREIGN PATENT DOCUMENTS

| | | |
|---|---|---|
| JP | 2004-200336 A | 7/2004 |
| JP | 2004-273471 A | 9/2004 |
| JP | 2010-165857 A | 7/2010 |

* cited by examiner

*Primary Examiner* — Elvin G Enad
*Assistant Examiner* — Kazi Hossain
(74) *Attorney, Agent, or Firm* — Carrier Blackman & Associates, P.C.; Joseph P. Carrier; William D. Blackman

(57) ABSTRACT

A coil component comprises: a coil bobbin, which has a coil-winding section in an outer circumferential portion so that a coil is to be wound on the coil-winding section, and which has a through-hole in a central portion thereof; a first core and a second core, which have a plurality of magnetic legs respectively, wherein a certain leg of the plurality of the magnetic legs of the first core and a certain leg of the plurality of the magnetic legs of the second core are inserted into the through-hole of the coil bobbin to face each other with a predetermined gap, and wherein facing surfaces of the certain legs of the magnetic legs are fixed by an adhesive; and a protective cover, which is positioned between the coil bobbin and the certain legs to suppress the adhesive from being attached to the coil bobbin.

5 Claims, 7 Drawing Sheets

FIG.7 -BACKGROUND ART-
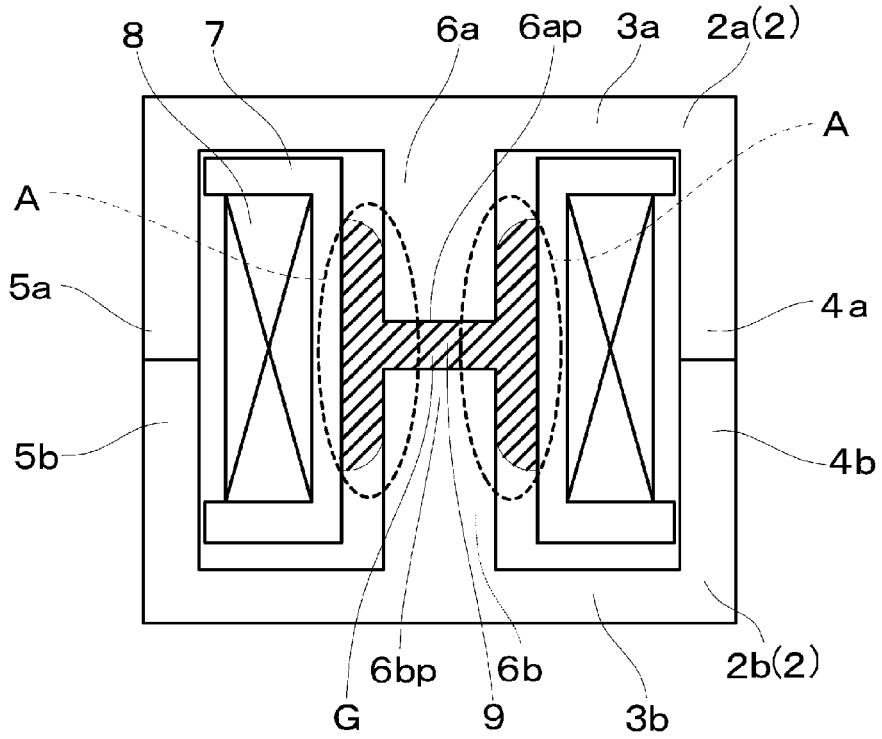

COIL COMPONENT

CROSS-REFERENCE TO RELATED APPLICATION

This application claims priority from Japanese Patent Application No. 2011-136922 filed on Jun. 21, 2011, the entire subject matter of which is incorporated herein by reference.

TECHNICAL FIELD

This disclosure relates to a coil component, and more specifically, to a coil component that includes a coil and a coil bobbin.

BACKGROUND

Previously, coil components, such as a transformer, a choke coil, a reactor or the like, have been widely used in electronic devices.

For example, in such coil components, a typical transformer includes a core (for example, a ferrite sintered product) and a coil bobbin on which a coil is wound. The core is divided into two core members. Each of the core members includes a yoke section and a plurality of magnetic legs (for example, the three of magnetic legs (three legs)). Respective magnetic legs of the two core members are arranged to face each other. In the case of the core member having three magnetic legs (for example, an E-type core), the respective middle magnetic legs (the magnetic leg positioned in the middle of the three magnetic legs, also referred to as 'middle leg') of the two core members are inserted into the through-hole of the coil bobbin so that the middle magnetic legs butt (face) each other. In order to adjust inductance, a predetermined gap is typically provided between the butting surfaces (facing surfaces) of the two magnetic legs, which are brought to butt each other.

In the transformer configured as the above, when current flows through the coil on the coil bobbin, the flux of the core changes. Due to the changing flux, the core repeats expansion and shrinkage to a slight amount. This is referred to as magnetostrictive vibration. Such magnetostrictive vibration causes beat note (noise). In order to reduce such beat note, there is known a method of suppressing the magnetostrictive vibration by filling the gap with an adhesive.

FIG. 7 is a cross-sectional view illustrating one of main configurations of a transformer of the background art.

The transformer of the background art shown in FIG. 7 includes a core 2 and a coil bobbin 7 on which a coil 8 is wound. The core 2 is configured by a first core 2*a* and a second core 2*b*.

The first core 2*a* is a so-called E-type core, which includes a yoke section 3*a*, side magnetic legs 4*a* and 5*a*, which are extended from the yoke section 3*a*, and a middle magnetic leg 6*a*. The second core 2*b* is also an E-type core, which includes a yoke section 3*b*, side magnetic legs 4*b* and 5*b*, which are extended from the yoke section 3*b*, and a middle magnetic leg 6*b*. Corresponding magnetic legs of the first core 2*a* and the second core 2*b* are arranged to face each other, thereby forming a so-called EE-type core.

The middle magnetic leg 6*a* of the first core 2*a* and the middle magnetic leg 6*b* of the second core 2*b* are fitted into a through-hole that is formed in the central portion of the coil bobbin 7. The middle magnetic leg 6*a* of the first core 2*a* is formed to be shorter than the side magnetic legs 4*a* and 5*a*. Therefore, a predetermined gap G (which is from several tens of micrometers to several millimeters, which is also referred to as an air gap) is formed between the butting surfaces 6*ap* and 6*bp* of the middle magnetic legs 6*a* and 6*b*. The gap G is filled with an adhesive 9. The adhesive 9 fixes the middle magnetic legs 6*a* and 6*b*.

In the transformer of the background art, the adhesive 9, which is disposed in the gap G, may protrude in the lateral direction of the middle magnetic legs 6*a* and 6*b* so as to reach the coil bobbin 7 (the protruding portion of the adhesive 9 is indicated by "A"). In this case, the coil bobbin 7 may be fixed to the middle magnetic legs 6*a* and 6*b* via the adhesive 9.

The transformer in which the coil bobbin and the middle magnetic legs are fixed via the adhesive has a problem in that the core has cracks or rupture due to stress applied thereto. This occurs due to the low mechanical strength of the core in addition to the following reasons (1) and (2).

(1) Since the coil bobbin and the core have different coefficients of thermal expansion (in general, the coil bobbin is more likely to expand in response to heating), the core is distorted at high temperature.

(2) Since the coil bobbin and the core have different water absorptivities (in general, the coil bobbin has a higher absorptivity and thus is more likely to imbibe), the core is distorted in a high-humidity condition.

As for the reason (1), the temperature of the transformer changes when the transformer is being manufactured as well as when the transformer is operating. That is, the thermal history of the transformer changes overtime when the transformer is being manufactured as well as when the transformer is operating. Therefore, the distortion due to the reason (1) is problematic for both the manufacture and the operation of the transformer. In addition, in thermal expansion/shrinkage test such as heat cycle test, distortion occurs due to the reason (1).

In addition, as for the reason (2), problems generally occur due to temporal changes in moisture after the transformer is shipped as a product.

JP-A-2004-200336 disclose a transformer in which the inner diameter of at least a portion of a coil bobbin that faces a magnetic leg butting portion of a core half structure is formed to be larger than those of the other portions. The inner diameter is increased in order to suppress a protruding adhesive from bonding the core and the coil bobbin to each other.

JP-A-2004-273471 discloses a transformer in which an insulating tape impregnated with varnish is wound on a middle leg. External force on the core, which is generated by drying/curing of varnish, is absorbed by the elasticity of the insulating tape.

JP-A-2010-165857 discloses a technology for suppressing natural vibration of magnetic legs by capping a transformer with a thermal-shrinking tube.

SUMMARY

JP-A-2004-200336 is intended to suppress the protruding adhesive from bonding the core and the coil bobbin to each other. However, this has the following problems.

(1) In JP-A-2004-200336, the inner diameter of a portion of the coil bobbin (the portion that faces the butting portion of the magnetic leg) is formed to be larger than the other portions. However, in this construction, when manufacturing the transformer, the coil bobbin and the middle magnetic legs may be fixed to each other via the adhesive since the amount of the adhesive that is applied is not uniform.

(2) It may be considered that the viscosity of the adhesive changes due to the influence of the surrounding environment, such as temperature, when manufacturing the transformer. As a result, when the viscosity of the adhesive is reduced, the adhesive may flow down during the operations in which the adhesive is being applied, so that the core member is being bonded to be attached to the coil bobbin.

In the meantime, according to the technologies of JP-A-2004-273471 and JP-A-2010-165857, the foregoing problem of the adhesive being attached to the coil bobbin is not solved.

In view of the above, this disclosure provides at least a coil component that suppresses a core and a coil bobbin from being bonded to each other.

According to one aspect of this disclosure, a coil component comprises a coil bobbin, which has a coil-winding section in an outer circumferential portion that is configured to have a coil wound thereon the coil-winding section, and which has a through-hole in a central portion thereof; a first core and a second core, which each have a plurality of magnetic legs, wherein a certain leg of the plurality of the magnetic legs of the first core and a certain leg of the plurality of the magnetic legs of the second core are inserted into the through-hole of the coil bobbin to face each other with a predetermined gap therebetween, and wherein facing surfaces of the certain legs of the magnetic legs are fixed together by an adhesive; and a protective cover, which is positioned between the coil bobbin and the certain legs to suppress the adhesive from being attached to the coil bobbin.

In the above-described aspect of this disclosure, a length of the protective cover may be at least sufficient in an axial direction of the predetermined magnetic legs to cover from a base to a portion, to which the adhesive is attached, of the certain leg of one of the first core and the second core so that the coil bobbin is prevented from being fixed to the certain legs when the adhesive is protruded from the gap.

In the above-described aspect of this disclosure, the protective cover is movable in an axial direction of the certain legs in an assembled state of the coil component, and a length of the protective cover may be at least sufficient to fully cover a portion of the certain legs, to which the adhesive is attached, even when the protective cover moves in the first and second cores in an axial direction of the certain legs.

In the above-described aspect of this disclosure, the protective cover may be a cylindrical component that covers an outer surface of the certain legs.

In the above-described aspect of this disclosure, the protective cover may be a sheet-shaped component that is wound around an outer surface of the certain legs to cover the outer surface thereof.

According to this disclosure, it is possible to provide a coil component that suppresses a core and a coil bobbin from being bonded to each other.

BRIEF DESCRIPTION OF THE DRAWINGS

The foregoing and additional features and characteristics of this disclosure will become more apparent from the following detailed descriptions considered with the reference to the accompanying drawings, wherein:

FIG. 7 is a cross-sectional view illustrating one of main configurations of a transformer of the background art.

DETAILED DESCRIPTION

Hereinafter, embodiments of this disclosure will be described with reference to the accompanying drawings. Although a transformer having a ferrite core will be illustrated as an example of a coil component in the following embodiments, the coil component is not limited thereto but may be implemented as a choke coil that has a core and a coil bobbin, a reactor, or the like.

[First Embodiment]

Figure 1:
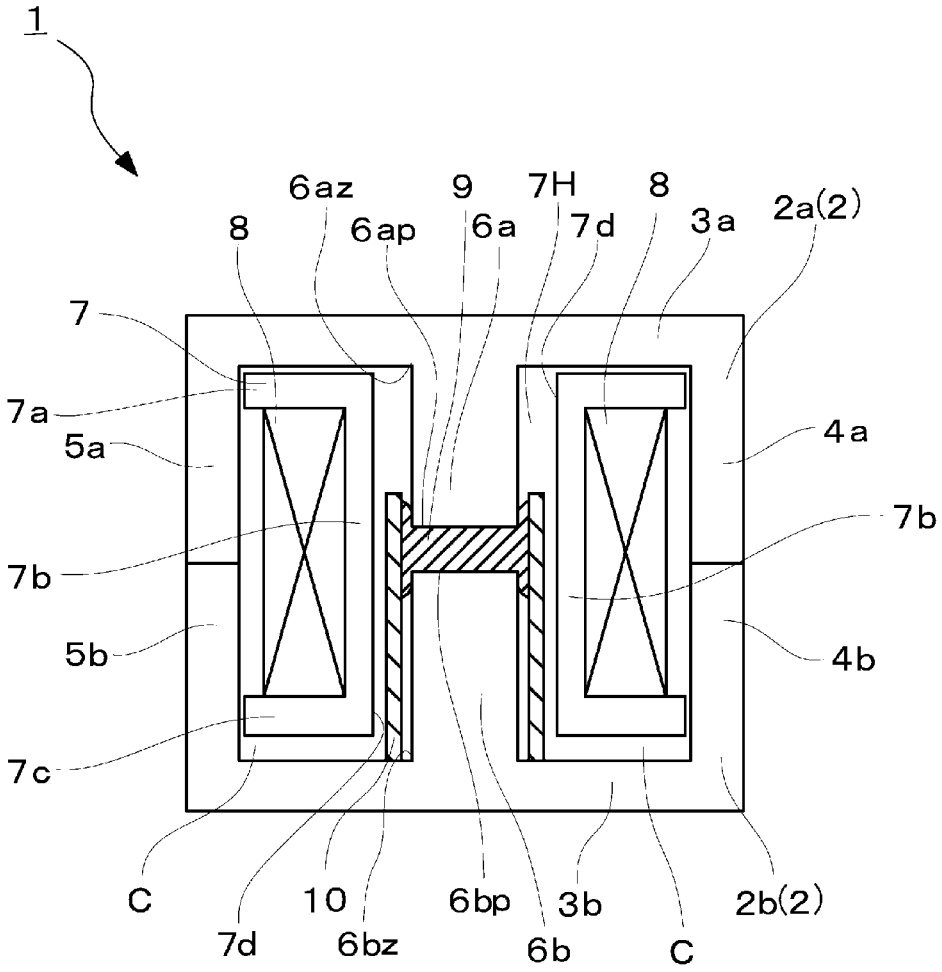
FIG. 1 is a cross-sectional view illustrating one of main configurations of a transformer according to a first embodiment of this disclosure.
Figure 2:
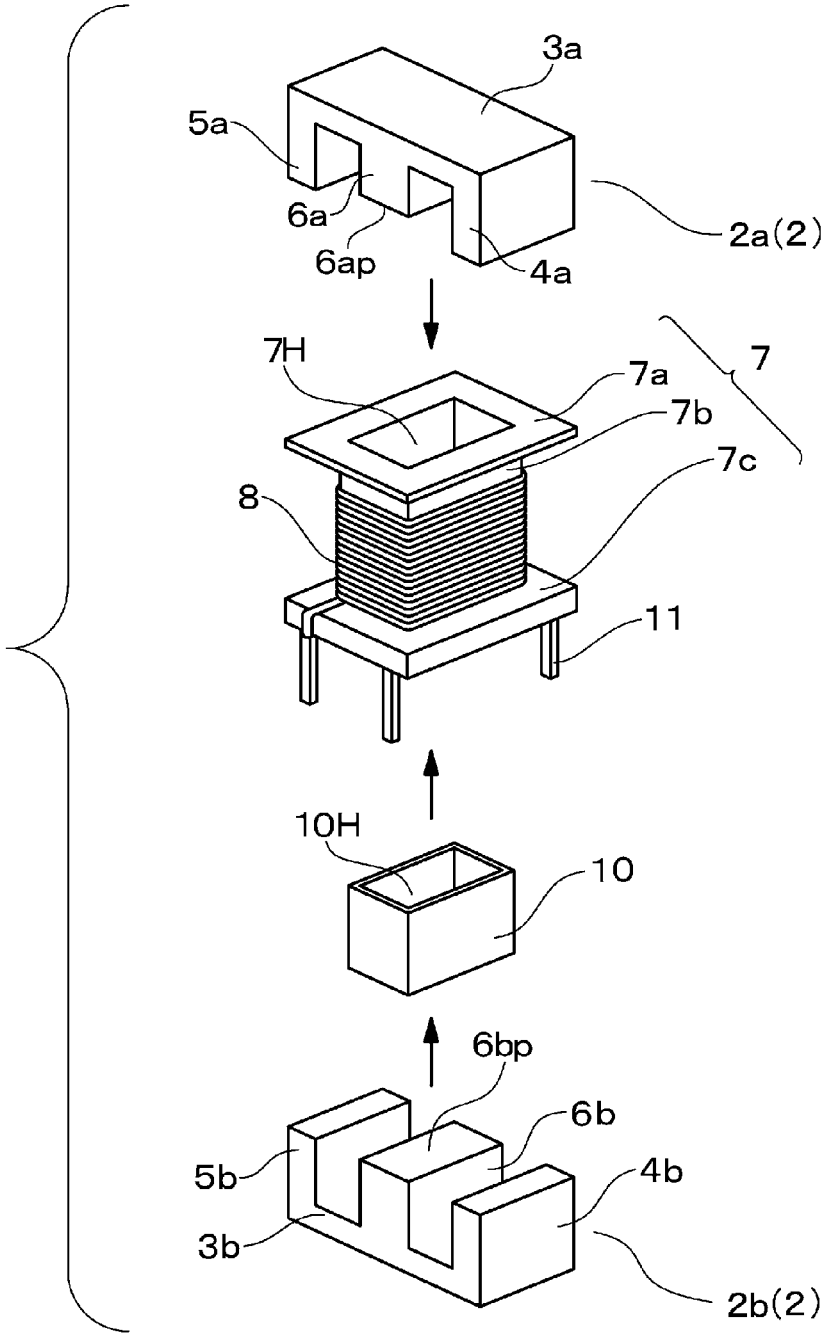
FIG. 2 is a perspective view illustrating an example of an assembly of the transformer shown in FIG. 1.

FIG. 1 is a cross-sectional view illustrating one of main configurations of a transformer 1 according to a first embodiment of this disclosure, and FIG. 2 is a perspective view illustrating an example of an assembly of the transformer 1 shown in FIG. 1.

As shown in FIG. 1 and FIG. 2, the transformer 1 includes a core 2 and a coil bobbin 7 on which a coil 8 is wound. The core 2 is configured by a first core 2*a* and a second core 2*b*. The coil bobbin 7 is made of, for example, phenol resin or the like.

The first core 2*a* is a so-called E-type core, which includes a yoke section 3*a*, side magnetic legs 4*a* and 5*a* and an middle magnetic leg 6*a*, which are extended from the yoke section 3*a*. The second core 2*b* is an E-type core, which includes a yoke section 3*b*, side magnetic legs 4*b* and 5*b* and an middle magnetic leg 6*b*, which are extended from the yoke section 3*b*. Corresponding magnetic legs of the first core 2*a* and the second core 2*b* are arranged so as to face each other, thereby forming a so-called EE-type core.

The middle magnetic leg 6*a* of the first core 2*a* and the middle magnetic leg 6*b* of the second core 2*b* are inserted into a through-hole 7H that is formed in the central portion of the coil bobbin 7. The middle magnetic leg 6*a* of the first core 2*a* is formed to be shorter than the side magnetic legs 4*a* and 5*a*. Therefore, a predetermined gap G (from several tens of micrometers to several millimeters) is formed between butting surfaces 6*ap* and 6*bp* of the middle magnetic legs 6*a* and 6*b*. Then, the gap G is filled with an adhesive 9. The adhesive 9 fixes the middle magnetic legs 6*a* and 6*b*.

A closed magnetic circuit defined by the core 2 is formed by assembling the first and second cores 2*a* and 2*b* together so that a respective end of the side magnetic legs 4*a* and 5*a* of the first core 2*a* is in close contact with a corresponding end of the side magnetic legs 4*b* and 5*b* of the second core 2*b*.

The length of the coil bobbin 7 in the axial direction (the vertical direction in FIG. 1) is shorter than the length from a base 6*az* of the middle magnetic leg 6*a* of the first core 2*a* to a base 6*bz* of the middle magnetic leg 6*b* of the second core 2*b*. Due to this, a clearance C is formed in the axial direction between the core 2 and the coil bobbin 7. The clearance C has the function of suppressing stress from being applied to the core 2 due to the expansion of the coil bobbin 7 caused by heat or moisture.

In the through-hole 7H of the coil bobbin 7, a gap is formed between the inner wall 7*d* of the coil bobbin 7 and the side surfaces of the middle magnetic legs 6*a* and 6*b*, and a cylindrical protective cover 10 having a through-hole 10H (FIG. 2) is disposed in the gap.

The protective cover 10 is arranged to suppress a portion of the adhesive 9 protruded in the lateral direction of the middle magnetic legs 6*a* and 6*b* (the horizontal direction in FIG. 1) from reaching the coil bobbin 7, so that the coil bobbin 7 and the middle magnetic legs 6*a* and 6*b* are not fixed to each other. The protective cover 10 extends a length in the axial direction of the middle magnetic legs 6*a* and 6*b* (the vertical direction in FIG. 1) so as to cover at least from one of bases 6*az* and 6*bz* of the middle magnetic legs 6*a* and 6*b* (the base 6*bz* of the middle magnetic leg 6*b* in FIG. 1) to an attached portion of the adhesive 9.

Specifically, the axial length of the protective cover 10 is determined by calculating a length required for protection, in consideration of the non-uniform amount of the adhesive 9 that is applied, the range in which the adhesive 9 protrudes on the side surface of the middle magnetic legs, and the like.

In addition, the protective cover 10 may move in the vertical direction of FIG. 1 in the state in which the adhesive 9 is not applied or the adhesive 9 is not solidified. In case that the protective cover 10 is in the lowest position, the lower end of the protective cover 10 butts the yoke section 3*b*. Meanwhile, in case that the protective cover 10 is in the highest position, the upper end of the protective cover 10 butts the yoke section 3*a*. Accordingly, it is preferable that the size of the protective cover 10 is determined so that the protective cover 10 can suppress the adhesive 9 from being attached to the coil bobbin 7, irrespective of the protective cover 10 being placed in any position in the axial direction of the middle magnetic legs 6*a* and 6*b*.

More specifically, it is preferable that the size of the protective cover 10 is set to a length such that it can cover all the attached portion of the adhesive 9 in case that the upper end of the protective cover 10 is contact with the yoke section 3*a*, and cover all the attached portion of the adhesive 9 in case that the lower end of the protective cover 10 is contact with the yoke section 3*b*.

Figure 3:
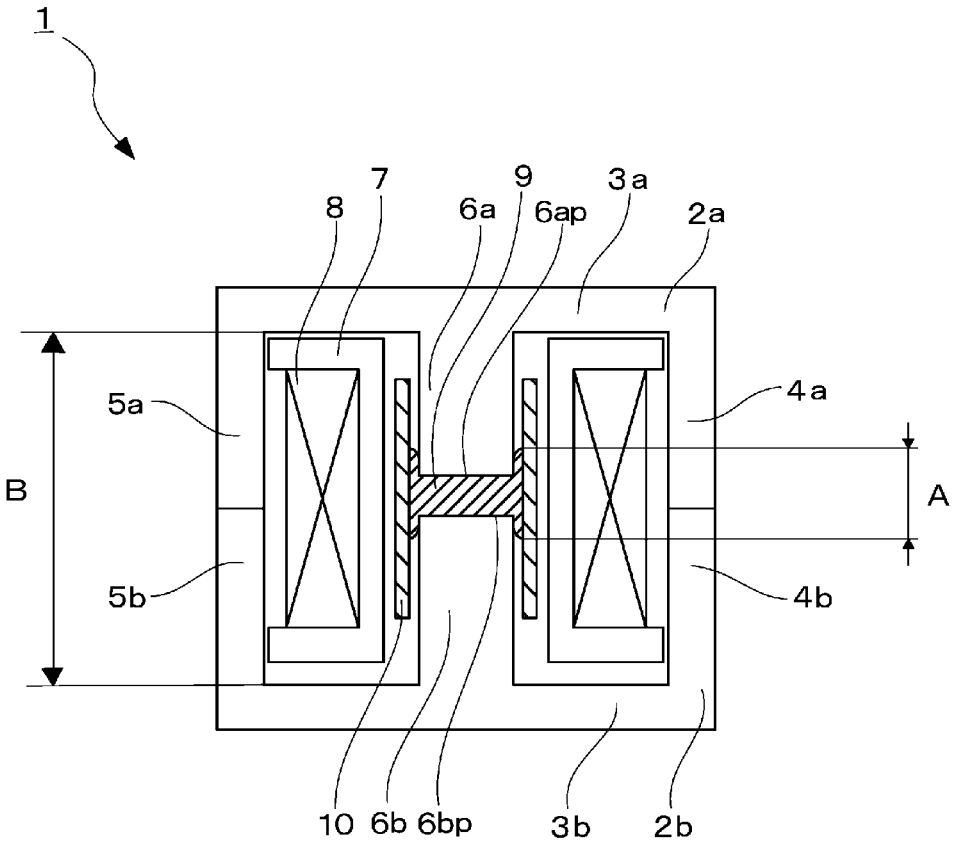
FIG. 3 is a view illustrating a protective cover positioned in an intermediate position in the longitudinal direction in first and second cores.

Since the protective cover 10 has the above-described dimension, even though the protective cover 10 moves to any position in the axial direction of the middle magnetic legs 6*a* and 6*b* within the gap between the inner wall 7*d* of the coil bobbin 7 and the side surfaces of the middle magnetic legs 6*a* and 6*b*, the protective cover 10 can suppress a attached range of the adhesive 9 from increasing. Therefore, even though the protective cover 10 moves, the adhesive 9 is not to be attached to the coil bobbin 7. (For example, as shown in FIG. 3, when the protective cover 10 is in the intermediate position in the vertical direction of FIG. 3 within the first and second cores 2*a* and 2*b*, the adhesive 9 is suppressed from being attached to the coil bobbin 7). The protective cover 10 may be in the fixed state by the adhesive 9 (in the not movable state), or be in a free state by the adhesive 9 (in the movable state).

Although the ideal size of the protective cover 10 is as discussed above, the effects of this disclosure can be obtained, when the lengthwise size of the protective cover 10 is the same as or smaller than the length B of FIG. 3 and is the same or greater than the length A that can cover all the attached portion of the adhesive 9. In addition, when it is difficult for the adhesive 9 to leak in the lateral direction from the space (the air gap) in which the butting surfaces 6*ap* and 6*bp* of the middle magnetic legs 6*a* and 6*b* face each other, the length A can be set to the size of the gap. (According to this, the protective cover 10 performs the function of suppressing the adhesive 9 from leaking in the lateral direction from the air gap.)

The material of the protective cover 10 may be formed by an insulator (having a thickness of, for example, several hundreds of micrometers), for example, liquid crystal polymer (LCP), phenol resin, or the like. However, the material is not limited to the insulator. The protective cover 10 may be configured such that it has a shield effect using a metal, such as copper, which can function as a shield.

Next, with reference to FIG. 2, an example of the assembly of the transformer 1 is described by dividing the assembly into the processes (1) to (5). (However, this disclosure is not limited to this example of the assembly.)

(1) The coil 8 is wound on a coil-winding section 7*b* of the coil bobbin 7. The coil-winding section 7*b* is positioned between an upper collar 7*a* and a lower collar 7*c*. One end of the coil 8 is drawn through the lower collar 7*c*, wound on a pin 11, and is bonded by, for example, soldering or the like.

(2) The protective cover 10 (having the shape of an angled box in this embodiment) is inserted into the through-hole 7H of the coil bobbin 7.

(3) The middle magnetic leg 6*b* of the second core 2*b* is inserted into the through-hole 10H of the protective cover 10, and the adhesive 9 is applied on the surface of the protruding portion (the butting surface 6*bp*) of the middle magnetic leg 6*b*. In addition, the adhesive is applied on the end surfaces (the butting surfaces) of the side magnetic legs 4*a*, 5*a*, 4*b* and 5*b*, as required.

(4) The middle magnetic leg 6*a* of the first core 2*a* is inserted into the through-hole 10H of the protective cover 10 in the direction (in the direction from top to bottom in FIG. 2) reverse to the direction in which the middle magnetic leg 6*b* of the second core 2*b* is inserted (in the direction from bottom to top in FIG. 2), and the first core 2*a* and the second core 2*b* are pressed so that the magnetic legs thereof face each other.

(5) Heating is performed at a high-temperature environment, and the adhesive 9 is cured.

Since the protective cover 10 is provided within the transformer 1 as described above, it is possible to suppress the adhesive 9 from fixing the middle magnetic legs 6*a* and 6*b* of the core 2 to the coil bobbin 7. That is, the core 2 is in the state of being freely movable with respect to the coil bobbin 7. This can securely suppress cracks or rupture from occurring in the core 2.

In addition, since the protective cover 10 can securely suppress the attached range of the adhesive 9 from increasing, it is no long necessary to strictly manage the amount of the adhesive 9 that is applied. Therefore, according to this embodiment, the productivity of the transformer 1 is not reduced. As in the background art, when the protective cover 10 is not provided, it is required to be careful on the amount of the adhesive 9 (i.e. be too careful so that the adhesive 9 is not excessive). Then, in some cases, the middle magnetic legs are not bonded to each other because the amount of the adhesive 9 is too small. When the middle magnetic legs are not bonded to each other, there is a problem in that beat note occur. In this embodiment, it is possible to suppress beat note, thereby improving in the quality of the transformer.

[Second Embodiment]

Figure 4:
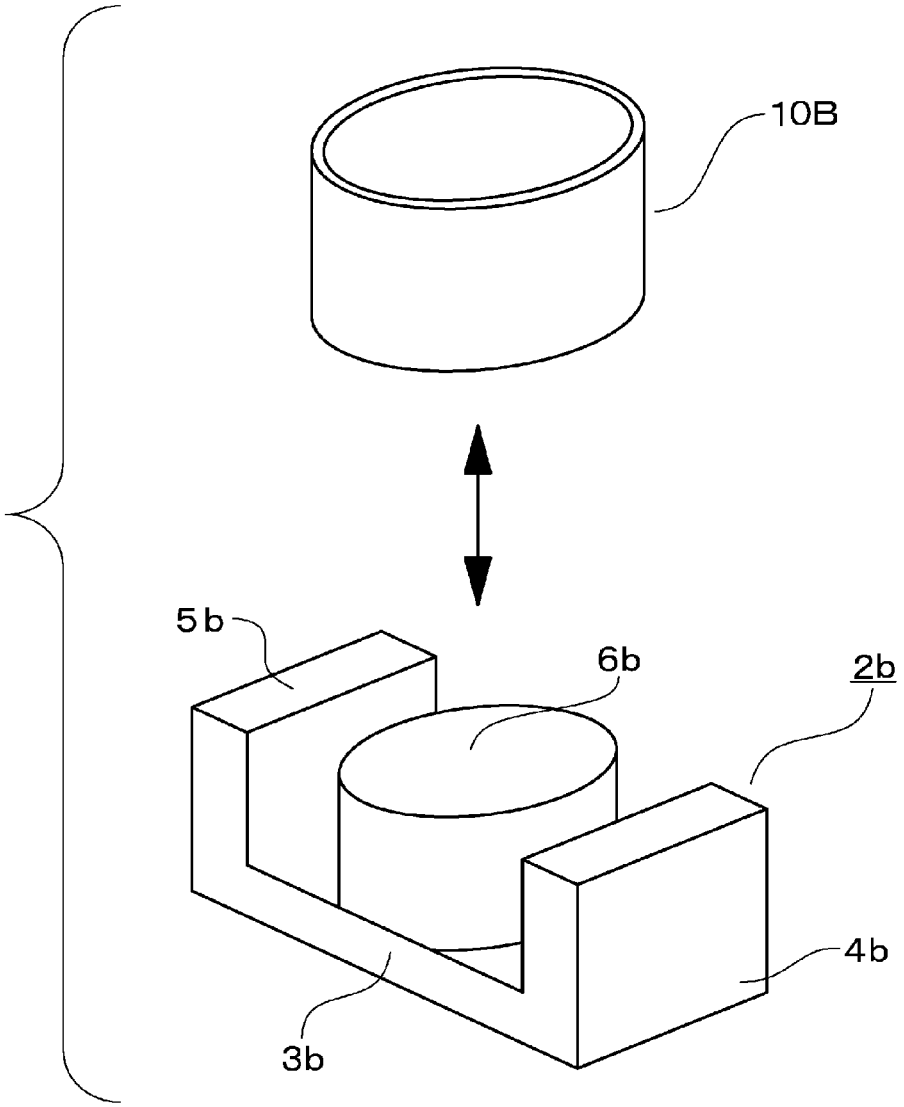
FIG. 4 is a view illustrating a part of a coil component according to a second embodiment of this disclosure.

FIG. 4 is a view illustrating part of a coil component according to a second embodiment of this disclosure.

The shape of the protective cover is not limited to the shape of an angled box shown in FIG. 2, but can be a cylindrical shape represented by the protective cover 10B in FIG. 4. In addition, in this case, it is preferable that the middle magnetic leg 6*b* have a circular cylindrical shape. That is, the protective cover may have a shape that corresponding to the shape of the middle magnetic leg of the core.

[Third Embodiment]

Figure 5:
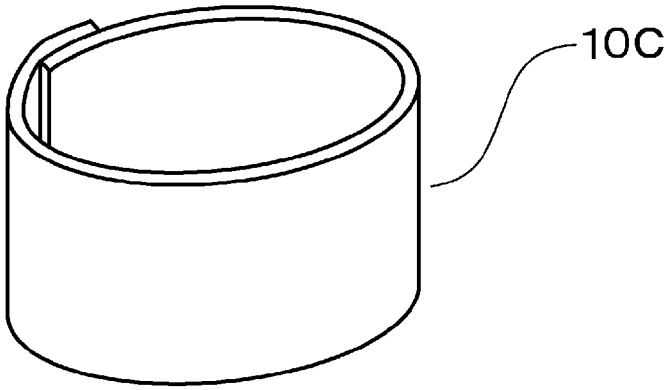
FIG. 5 is a perspective view illustrating a protective cover of a coil component according to a third embodiment of this disclosure.

FIG. 5 is a perspective view illustrating a protective cover of a coil component according to a third embodiment of this disclosure.

The protective cover is not limited to a cylindrical component as shown in FIG. 4, but can be made using a thin sheet-shaped component (having a thickness of, for example, several tens of micrometers), as represented by the protective cover 10C in FIG. 5. The protective cover 10C may be formed by winding the sheet-shaped component to cover the outer portion (outer circumferential portion) of the middle magnetic leg 6*b* shown in FIG. 4. In this way, the component can be manufactured at low cost.

[Fourth Embodiment]

Figure 6:
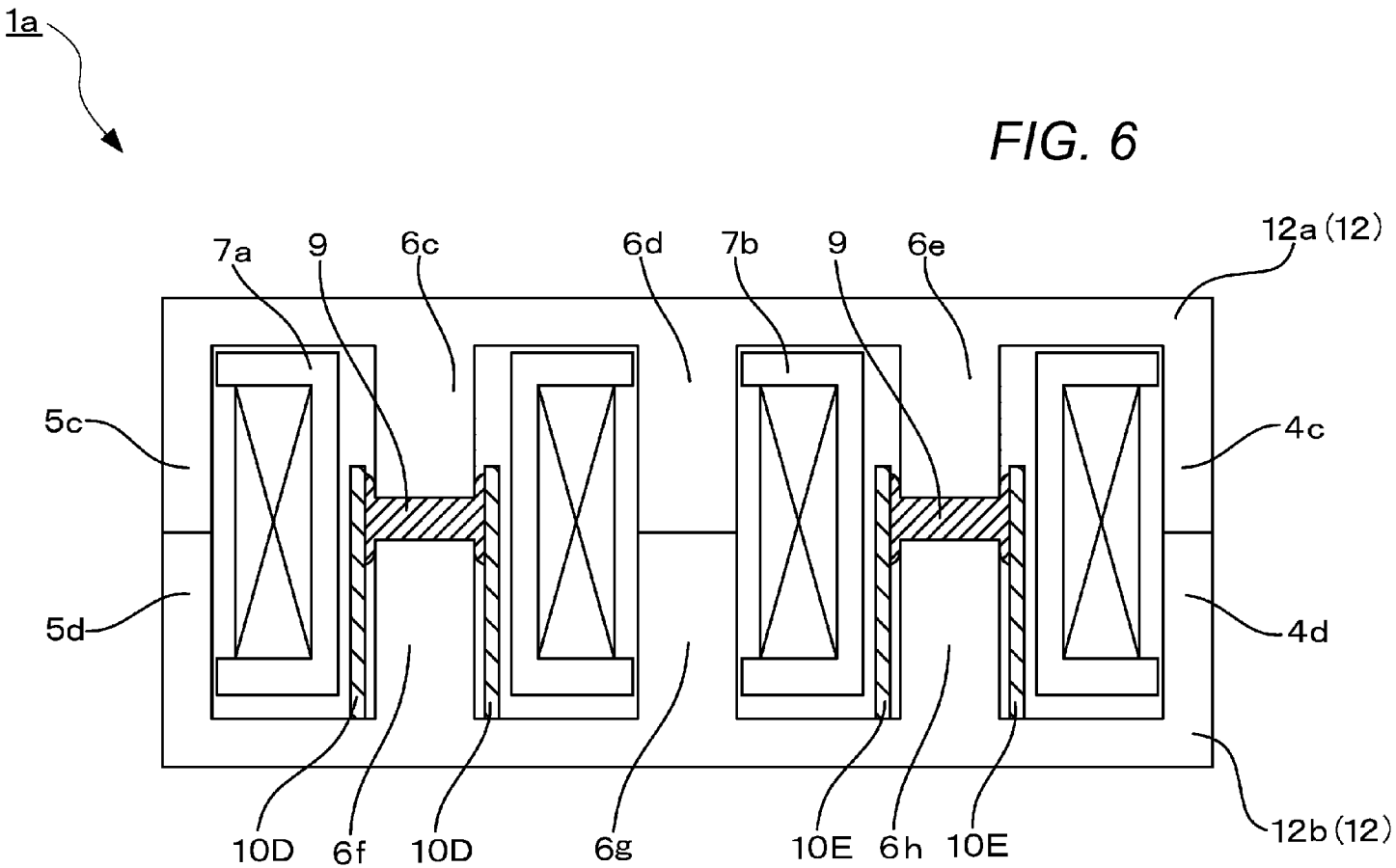
FIG. 6 is a cross-sectional view illustrating one of main configurations of a transformer according to a fourth embodiment of this disclosure.

FIG. 6 is a cross-sectional view illustrating one of main configurations of a transformer according to a fourth embodiment of this disclosure.

The core of the transformer is not limited to the structure that has three legs, as shown in FIG. 1 to FIG. 4. For example, as shown in FIG. 6, the transformer 1*a* may include a core member that has five legs. In FIG. 6, the transformer 1*a* includes the core 12, which is configured by a first core 12*a* and a second core 12*b*. The first core 12*a* has side magnetic legs 4*c* and 5*c* and middle magnetic legs 6*c*, 6*d* and 6*e*. The second core 12*b* has side magnetic legs 4*d* and 5*d* and middle magnetic legs 6*f*, 6*g* and 6*h*.

Among the middle magnetic legs, the middle magnetic legs 6*c*, 6*f*, 6*e* and 6*h*, on which the adhesive 9 is applied, are surrounded by protective covers 10D and 10E. This configuration suppresses the adhesive 9 from being attached to the coil bobbin 7*a* and 7*b*.

[Modified Embodiment]

The coil component is not limited to the transformer, but may be implemented as a choke coil, a reactor, or the like.

The core shape is not limited to the EE-type, but may be implemented as, for example, a PQ-type, an EER-type, a UU-type, or the like. For example, in the case of the UU-type, the respective magnetic legs of the two U-type cores are arranged to face each other. In some cases, the UU-type is configured such that a gap sheet is positioned between the facing magnetic legs to form a gap between the facing surfaces of the magnetic legs and an adhesive is applied around the gap sheet. In this case, the protective cover is to be arranged on the bonded portion to suppress the coil bobbin and the magnetic legs from being fixed to each other.

The coil component is configured as described above. The coil component includes a coil bobbin on which a coil is wound on first and second cores, which have a plurality of magnetic legs, respectively. A certain leg of the first core and a certain leg of the second core are inserted into the through-hole of the coil bobbin to face each other with a predetermined gap, and facing surfaces of the certain leg are fixed to each other by an adhesive. A protective cover is arranged between the coil bobbin and the certain legs to suppress the adhesive from being attached to the coil bobbin.

Due to the configuration in which the certain legs are bonded to each other, it is possible to reduce beat note in the coil component. In addition, since the use of the protective cover suppresses the adhesive from being attached to the coil bobbin, it is possible to securely suppress cracks or rupture occurring in the core.

It is considered that the foregoing embodiments are illustrated in all view but not limitative. The scope of this disclosure is defined by the foregoing description and is extended to all changes that are made without departing from this disclosure and equivalents thereof.

What is claimed is:

1. A coil component comprising:

a coil bobbin, which has a coil-winding section in an outer circumferential portion that is configured to have a coil wound thereon, and which has a through-hole in a central portion thereof;

a first core and a second core, which each have a plurality of magnetic legs, wherein a certain leg of the plurality of the magnetic legs of the first core and a certain leg of the plurality of the magnetic legs of the second core are inserted into the through-hole of the coil bobbin to face each other with a predetermined gap there between, and wherein facing surfaces of the certain legs of the magnetic legs are fixed together by an adhesive; and a protective cover, which is positioned between the coil bobbin and the certain legs to suppress the adhesive from being attached to the coil bobbin, wherein a length of the protective cover is less than an axial length of the through-hole of the coil bobbin, and a diameter of the protective cover less than a diameter of the through-hole of the coil bobbin and greater than a diameter of the certain legs of the first and second cores, and wherein the protective cover is spaced from the bobbin.

2. The coil component according to claim 1, wherein the length of the protective cover is at least sufficient in an axial direction of the certain legs of the magnetic legs to cover from a base to a portion, to which the adhesive is attached, of the certain leg of one of the first core and the second core so that the coil bobbin is prevented from being fixed to the certain legs when the adhesive is protruded from the gap.

3. The coil component according to claim 1, wherein the protective cover is movable in an axial direction of the certain legs in an assembled state of the coil component, and wherein the length of the protective cover is at least sufficient to fully cover a portion of the certain legs, to which the adhesive is attached, even when the protective cover moves in the first and second cores in an axial direction of the certain legs.

4. The coil component according to claim 1, wherein the protective cover is a cylindrical component that covers an outer surface of the certain legs.

5. The coil component according to claim 1, wherein the protective cover is a sheet-shaped component that is wound around an outer surface of the certain legs to cover the outer surface thereof.

* * * * *